US010898927B2

(12) United States Patent
Ripley et al.

(10) Patent No.: US 10,898,927 B2
(45) Date of Patent: Jan. 26, 2021

(54) WASTE CLASSIFICATION SYSTEMS AND METHODS

(71) Applicant: Waste Repurposing International, Inc., Austin, TX (US)

(72) Inventors: Christopher Barnard Ripley, Lichtfield, CT (US); Charles Bartol Vallely, Austin, TX (US)

(73) Assignee: Waste Repurposing International, Inc., Austin, TX (US)

( * ) Notice: Subject to any disclaimer, the term of this patent is extended or adjusted under 35 U.S.C. 154(b) by 0 days.

(21) Appl. No.: 16/159,652

(22) Filed: Oct. 13, 2018

(65) Prior Publication Data

US 2020/0114394 A1 Apr. 16, 2020

(51) Int. Cl.
*B07C 5/34* (2006.01)

(52) U.S. Cl.
CPC ..... *B07C 5/3416* (2013.01)

(58) Field of Classification Search
CPC ..... B07B 5/3412; B07B 5/3416
USPC ..... 209/552, 577, 583
See application file for complete search history.

(56) References Cited

U.S. PATENT DOCUMENTS 5,186,336 A * 2/1993 Pippin ..... B07C 5/3412 198/367.2
2002/0026768 A1* 3/2002 Duncan ..... B65B 25/008 53/52
2005/0119916 A1* 6/2005 Mallett ..... G06Q 10/30 705/2
2012/0203760 A1 8/2012 Abraham et al.
2013/0168300 A1* 7/2013 Malone ..... B07C 5/3412 209/583
2013/0180892 A1* 7/2013 Marrapodi ..... B65F 1/0033 209/10
2015/0034534 A1 2/2015 Mallett
2016/0042320 A1* 2/2016 Dearing ..... G06Q 10/08355 705/338
2017/0300493 A1 10/2017 Ripley
2017/0372159 A1* 12/2017 Schimmel ..... G06K 9/3233
2018/0016096 A1 1/2018 Krishnamurthy et al.
2018/0065155 A1 3/2018 Ripley

FOREIGN PATENT DOCUMENTS

CN 104443921 A 3/2015
CN 106429101 A 2/2017
KR 102010013795 A 12/2010

OTHER PUBLICATIONS

International Search Report, PCT/US19/55568 (9 pages) dated Jan. 30, 2020.

* cited by examiner

*Primary Examiner* — Terrell H Matthews
(74) *Attorney, Agent, or Firm* — RM Reed Law PLLC

(57) ABSTRACT

In some embodiments, a system may include an item sorter device. The item sorter device may include at least one optical device configured to capture optical data associated with a waste product, a display, and a processor coupled to the at least one optical device and to the display. The processor may be configured to automatically extract universal product code (UPC) data from the optical data, search one or more data sources based on the UPC data to determine a match, determine a bin of a plurality of bins for storage of the waste product based on the match and based on site-specific classification rules, and provide a graphical interface to the display indicating the determined bin.

17 Claims, 8 Drawing Sheets

WASTE CLASSIFICATION SYSTEMS AND METHODS

FIELD

The present disclosure is generally related to waste disposal, and more particularly, to systems, methods, and devices configured to automatically identify, classify, and guide disposal of waste products, such as household hazardous waste products and other waste products.

BACKGROUND

Certain types of products, such as chemical products, paint products, and other products (including those that cannot be identified), may sometimes be classified as hazardous waste products, which cannot be disposed of in a landfill. For example, laundry detergent, bleach, cleaning products, paints, aerosols, and other products may be sufficiently safe that such products can be placed on store shelves, can be sold to consumers without a special permit or license, and can be transported in a standard automobile. However, such items must be disposed of carefully. In addition, and sometimes more importantly, such items must be disposed of separately.

SUMMARY

Embodiments of systems, methods, and devices disclosed herein may be configured to identify contents of a particular waste product, and to appropriately classify each waste item into reuse and disposal shipping bins. In a particular embodiment, the system may include a single-item sorter device that can be configured to scan or otherwise capture image data associated with a waste item, to utilize the image data to automatically identify the waste item, and to classify the waste item into an appropriate disposal bin.

In some embodiments, an unknown waste item may be automatically identified and classified into a selected shipping bin or a selected disposal bin using automated product tagging and bin rules. In one aspect, product tagging may include assigning a label to the waste product as a product type, such a solid, liquid, aerosol, toxic, non-toxic, flammable, non-flammable, non-regulated, and so on. The product labels may be determined by performing a plurality of searches or queries and by processing retrieved product records to determine attributes of each of a plurality of products, each of which may be associated with one or more tags.

In some embodiments, classification of a particular product into a disposal bin may include both determining a plurality of tags of a particular waste product and applying rules associated with a particular facility. For example, a first store may define a first plurality of rules, and a second store may define a second plurality of rules. Further, in some embodiments, a municipality may define a plurality of rules for sorting waste at a waste disposal facility, which rules may be more or less granular and restrictive than the rules defined by a particular store. Other embodiments are also possible.

In some embodiments, a system may include an item sorter device. The item sorter device may include at least one optical device configured to capture optical data associated with a waste product, a display, and a processor coupled to the at least one optical device and to the display. The processor may be configured to automatically extract universal product code (UPC) data from the optical data, search one or more data sources based on the UPC data to determine a match, determine a bin of a plurality of bins for storage of the waste product based on the match and based on site-specific classification rules, and provide a graphical interface to the display indicating the determined bin. In some aspects, when the match cannot be determined, the processor may send data to a waste identification system through a network and, in response, the processor may receive at least one of classification data and a bin assignment for the waste product. Other embodiments are also possible.

In still other embodiments, a system may include a waste identification system including a network interface coupled to a network and a processor coupled to the network interface. The processor may be configured to receive data from an item sorter device through the network. The received data may include at least one of universal product code (UPC) data and optical data associated with an unidentified waste product. The processor may be further configured to automatically activate one or more web scrapers to retrieve data corresponding to the received data from a plurality of data sources through the network, automatically compile the retrieved data into a record, and selectively apply tags defining characteristics of the waste product to data within the record. The processor may also be configured to send the record to the item sorter device to classify the unidentified waste item into a bin of a plurality of bins.

In yet other embodiments, a method may include scanning a waste product to capture optical data and comparing data corresponding to the optical data of the waste product to identified product data in a memory of an item sorter device to determine a match. The method may further include, in response to determining the match, automatically determining a bin of a plurality of bins into which the waste product is to be sorted and providing a graphical interface to a display device of the item sorter device to identify the bin. Additionally, when the match is not determined, the method may include automatically sending the data corresponding to the optical data to a waste identification system through a network, receiving a record corresponding to the waste item from the waste identification system through the network, and providing the graphical interface to the display device of the item sorter device to identify the bin.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Figure 1:
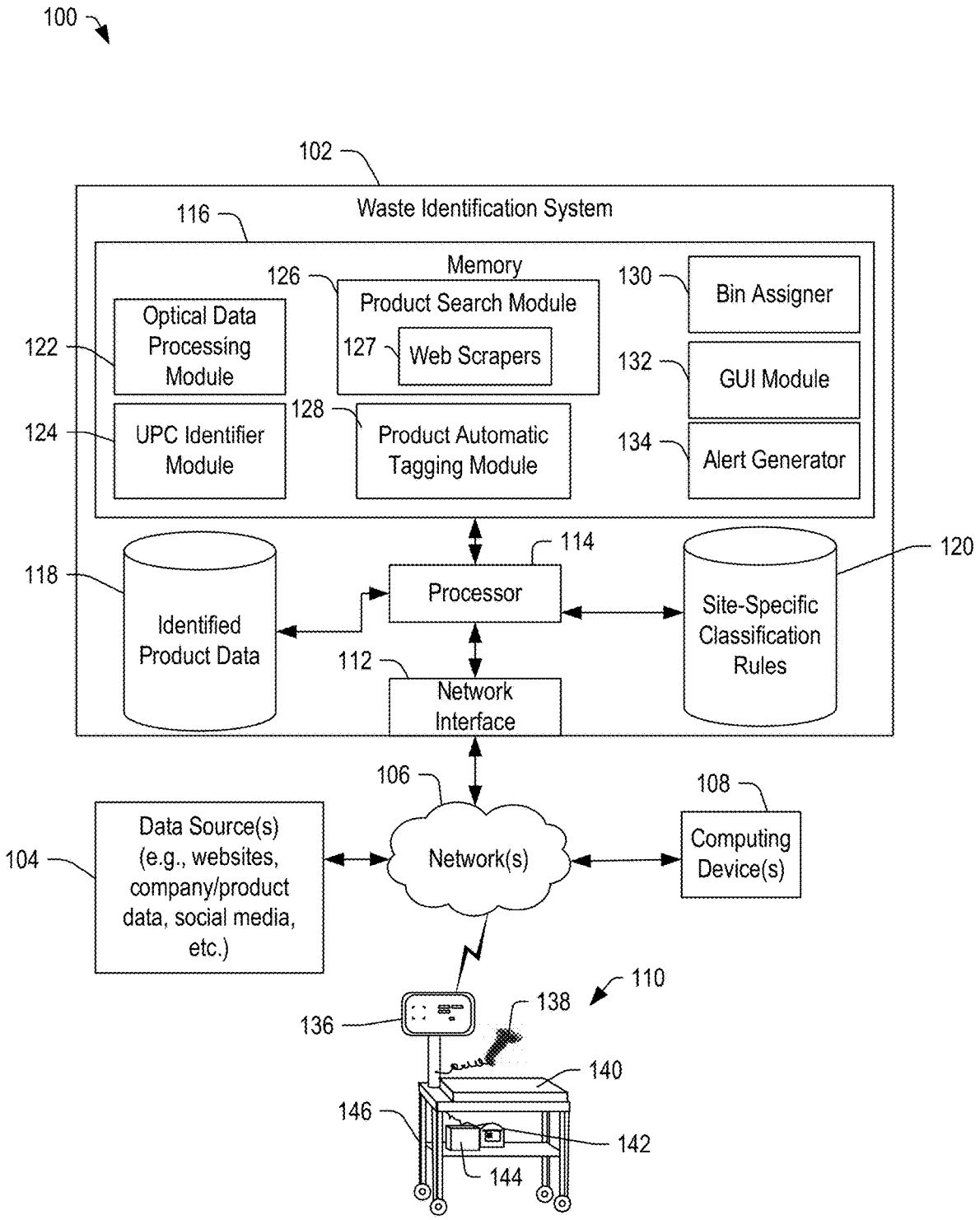
FIG. 1 depicts a block diagram of a waste product identification system including a waste identification system coupled to one or more item sorter devices, in accordance with certain embodiments of the present disclosure.

Embodiments of systems, methods, and devices are described below that can be used to identify waste products optically and to classify the waste products, automatically. Once the waste product is classified, the systems, methods, and devices may be configured to store the classified waste product into an appropriate bin for safe storage and optionally disposal.

It should be appreciated that, in some instances, a waste item may include a chemical or chemical combination that may be deemed unsafe for disposal in a landfill. In some instances, some waste products may include chemicals that can be safely stored and transported, as long as those waste products are not mixed with other waste products formed from different chemicals that, when mixed, may form a toxic and dangerous mixture. However, it may not always be readily apparent to the individual, such as a store employee, that a particular item requires regulated handling.

Conventionally, manual handling and disposal of such waste items may rely heavily on the experience and knowledgebase of the individual employee tasked with disposing of such items. While, over time, an employee can become skilled in such sorting, mistakes can be made, which mistakes can be costly to a company (or an individual), particularly when such mistakes rise to the level of a regulatory violation. Embodiments of the present disclosure may operate to eliminate the mistakes by eliminating employee guess-work from the decision-making process.

In particular, embodiments of the present disclosure may include a device including at least one optical sensor (such as a camera, a scanner, another type of optical sensor, or any combination thereof), which may be used to capture optical data (such as a bar code, a Universal Product Code (UPC), other images, or any combination thereof) associated with the packing of a waste product. Further, the device may include a scale, pressure transducer, or other device to determine a weight associated with the waste product. The waste product may be a commercially available product, which (for whatever reason) cannot be sold on a store shelf. For example, damaged packaging and other defects may result in the product being marked for disposal, and thus the product becomes a waste product to be disposed of according to various disposal rules and regulations. The device may further include a processor coupled to the optical sensor and the scale. The processor may be configured to identify the waste product, classify the waste product based on its composition, and automatically select a waste bin from a plurality of waste bins into which the waste product should be placed according to its composition and according to location-specific disposal rules.

In a particular embodiment, a measured weight of each waste item may be associated with the waste product and may be correlated to the overall weight of the bin into which the waste product is placed. Subsequently, when the plurality of waste products within a bin are readied for transportation and optionally disposal, the weight of each waste product and the overall weight may be confirmed by weighing a shipping container including the contents from a particular bin. Further, the device may include a printer configured to print a shipping label and an associated manifest for the shipping container.

In some embodiments, when the device is unable to identify the waste product and determine its composition by searching a local database based on the optical data, the device may communicate optical data (such as the UPC and other data) to a waste identification system through a communications network. The waste identification system may use web scrapers, bots, or other automated web crawlers or spiders to search for and retrieve data corresponding to the optical data. The waste identification system may merge the retrieved data into a combined data record. The combined data record may then be processed automatically to classify the waste product based on the data record, may be provided to a human classifier (an employee of the company handling the waste product, an employee of a company associated with the waste identification system, or another individual), or any combination thereof to determine a waste bin for storage and disposal (or reuse) of the waste product. Other embodiments are also possible.

It should be appreciated that, in the context of a commercial enterprise, disposal or classification rules for disposing of waste items may be governed by corporate policy, regulations (municipal, state, and federal), and cost considerations. However, correct classification of waste items can prevent unnecessary expenditures, allowing an employee to select an appropriate level of disposal, as opposed to automatically electing a most costly disposal method (such as sending the waste item to a facility for burning with other "household hazardous waste"). Accordingly, the item sorter device and waste item identification systems may operate to improve employee efficiency with respect to waste handling, to reduce waste handling errors, to improve cost efficiencies, and to produce accurate records with respect to disposal of waste items.

FIG. 1 depicts a block diagram of a waste product identification system 100 including a waste identification system 102 coupled to one or more item sorter devices 110, in accordance with certain embodiments of the present disclosure. The waste identification system 102 may be communicatively coupled to the item sorter device 110, one or more data sources 104, and one or more computing devices 108 through a network 106. The network 106 may include the Internet; cellular, satellite, and digital communications networks; public switched telephone networks; short-range wireless networks, or any combination thereof.

The item sorter device 110 may include optical sensors (such as cameras, bar code scanners, other optical sensors, or any combination thereof), a scale, a processor, a display interface, and an input interface. In some embodiments, the item sorter device 110 may be coupled to a moveable cart. The item sorter device 110 can be configured to be operated by a user to scan and weigh waste items. The item sorter device 110 may automatically identify the waste product, determine a disposal category associated with the waste product, and provide information to the display interface identifying a bin into which the waste product is to be placed for storage.

The waste identification system 102 may include a network interface 112 configured to communicate with the network 106. Further, the waste identification system 102 may include a processor 114 coupled to the network interface 112. The waste identification system 102 can also include a memory 116 coupled to the processor 114 and configured to store data and instructions that, when executed, may cause the processor 114 to identify and classify a waste product based on information received from the item sorter device 110 and optionally one or more data sources 104. The waste identification system 102 may further include a database of identified product data 118 and a database of site-specific classification rules 120. In some embodiments, the identified product data 118 and the site-specification classification rules 120 may be stored in the memory 116.

The memory 116 may include an optical data processing module 122 that, when executed, may cause the processor 114 to receive optical data associated with an unidentified waste product from an item sorter device 110 and to extract data from the optical data, such as a UPC, a serial number, a product name, other information, or any combination thereof. The memory 116 may further include a UPC identifier module 124 that, when executed, may cause the processor 114 to utilize the data extracted by the optical data processing module 122 to identify a UPC code within the optical data.

The memory 116 can also include a product search module 126 that, when executed, may cause the processor 114 to search the identified product database 118, one or more data sources 104, or any combination thereof to identify a waste product associated with the UPC code data. In some embodiments, the product search module 126 may activate one or more web scrapers 127, which may include bots, spiders, or other automated web crawlers configured to identify and retrieve data associated with the waste product. The product search module 126 may also cause the processor 114 to determine a reliability value for the data retrieved.

In a particular example, multiple safety data sheets (SDSs) may be retrieved for a particular waste product. In some instances, the different SDS documents may be for the same branded product but published on different dates. In other instances, the different SDS documents may refer to the same product sold under different brand names or generic versions of the same product. In other instances, one or more of the SDS documents may be identical documents that are published on different dates. The product search module 126 may cause the processor 114 to compare such documents to determine differences and similarities and to select one of the documents for inclusion in the combined data record. In some embodiments, the product search module 126 may cause the processor 114 to select the most recent version of the SDS document or to select a version of the SDS document that can be linked directly to the waste product (by the UPC code, by ancillary data from the manufacturer's website, or from other information). In some embodiments, the SDS document may be directly matched to the UPC or other data of the waste product, resulting in a 100% reliability. However, in some instances, some uncertainty may exist in the automated mapping of the SDS documents to the waste product. In some embodiments, when the uncertainty exceeds a threshold or the reliability value falls below a threshold, the product search module 126 may cause the processor 114 to provide the combined record and supporting data to a human classifier to evaluate the combined record. In other embodiments, when the uncertainty exceeds a threshold or the reliability value falls below a threshold, the product search module 126 may cause the processor 114 to selectively assign a most restrictive disposal category to the waste product based on the combined data record. Other embodiments are also possible.

The memory 116 can further include a product automatic tagging module 128 that, when executed, may cause the processor 114 to combine the retrieved data and the reliability value into a data record, by organizing the retrieved data into a plurality of pre-defined fields and assigning tags to data fields of the combined data record or indexing the data record to enable searches. The product automatic tagging module 128 may also cause the processor 114 to store the combined data record into the identified product data database 118.

The memory 116 may include a bin assigner 130 that, when executed, may cause the processor 114 to retrieve site-specific classification rules 120 associated with a location corresponding to the item sorter device 110 and to apply the retrieved rules to the classification determined from the combined data record to determine a bin into which the waste product should be placed. In some instances, if the reliability value is less than a threshold reliability, the bin assigner 130 may provide a recommended bin assignment, the combined data record, and the determined classification (as well as the reliability value) to a graphical user interface (GUI) module 132. The GUI module 132, when executed, may cause the processor 114 to send a graphical interface including user-selectable elements and including the recommended bin assignment to a human classifier at a computing device 108 to verify the recommended assignment. In some embodiments, the graphical interface may also include one or more links accessible by the user to view SDS documents or other documents used to determine the classification and the bin assignment. Other embodiments are also possible.

In some embodiments, the memory 116 may further include an alert generator 134 that, when executed, may cause the processor 114 to generate an alert to one of a human classifier and the item sorter device 110. The alert sent to the human classifier may include a text message, a phone call, an audio signal, or other detectable indicator that can attract the attention of the human classifier so that the human classifier can review the graphical interface. The alert sent to the item sorter device 110 may include a message that the previously unknown item has been identified and assigned to a bin and may include instructions to rescan the waste item. Further, the alert may include an update to a local database of the item sorter device 110 so that subsequent scans of similar items can be readily identified and classified. In some embodiments, the alert generator 134 may also send a message to other item sorters through the network to update their local databases with identification/classification information, making it possible for other item sorters to benefit from the completed "round trip" identification. Other embodiments are also possible.

The item sorter device 110 may include a computing device 136 including a display. The computing device 136 may be coupled to a barcode reader 138 or other optical scanning device. Further, the computing device 136 may be coupled to a scale 140 and to a printer 142, such as a label printer. The computing device 136 may also receive power from a power supply, such as a battery 144, which allows the item sorter device 110 to be portable. In some embodiments, the computing device 136, the barcode reader 138, the scale 140, the printer 142, and the battery 144 may be coupled to a table or cart 146. In this example, the cart 146 includes wheels, which may allow the user to move the item sorter device 110 as needed. Other embodiments are also possible.

In operation, each item sorter device 110 may operate as a standalone device capable of scanning waste items, identifying the scanned waste items, classifying the scanned waste item into an appropriate bin for storage and transportation, and alerting the operator (an employee tasked with sorting waste products) via a display interface. However, when the item sorter device 110 is unable to identify the waste item in its local database, the item sorter device 110 can communicate UPC code data and other optical data to the waste identification system 102 for assistance. The waste identification system 102 may automatically (or with the assistance of a human classifier) identify the waste item and classify the waste item. The waste identification system 102 may also optionally determine a bin into which the waste item should be placed. The determined information may then be communicated to the item sorter device 110 so that the waste item can be handled appropriately, such as by placing the waste item into the appropriate bin for storage and optionally transportation.

Figure 2:
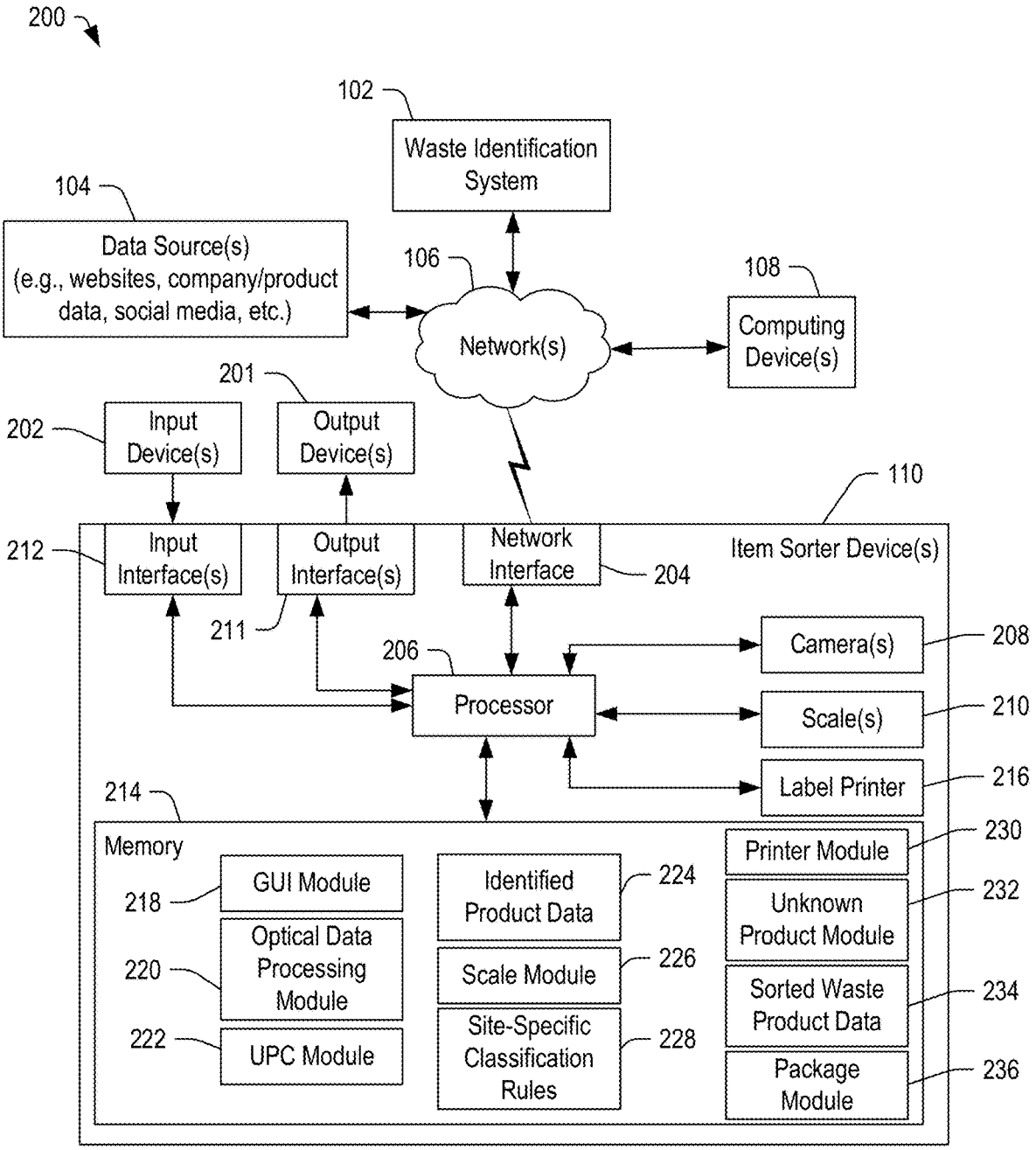
FIG. 2 depicts a block diagram of the waste product identification system including a waste identification system coupled to one or more item sorter devices, in accordance with certain embodiments of the present disclosure.

FIG. 2 depicts a block diagram 200 of the waste product identification system 100 including a waste identification system 102 coupled to one or more item sorter devices 110, in accordance with certain embodiments of the present disclosure. The waste identification system 102 may be coupled to one or more data sources 104, one or more computing devices 108, and one or more item sorter devices 110 through a communications network 106.

Each item sorter device 110 may be configured to couple to one or more output devices 201 (such as a display device) and to one or more input devices 202, such as a keyboard, a stylus, a mouse, a scanner, another input device, or any combination thereof. In some embodiments, a display device may be implemented as a touchscreen, which may thus operate as both an output device 201 and an input device 202. The item sorter device 102 may include a network interface 204, which may be configured to send and receive data and optionally processor-readable instructions to the waste identification system 102 through the network 106. The item sorter device 110 may also include a processor 206 coupled the network interface 204.

The item sorter device 110 may further include one or more cameras (or optical sensors configured to capture image data) 208, one or more scales 210 (or pressure transducers), and one or more printers 216. The item sorter device 110 may include one or more output interfaces 211 configured to couple to the one or more output devices 201 and one or more input interfaces 212 configured to couple to the one or more input devices 202. The processor 206 may be coupled to the one or more cameras 208, the one or more scales 210, the one or more printers 216, and the one or more input interfaces 212. Further, the item sorter device 110 may include a memory 214 that is coupled to or otherwise accessible to the processor 206 and that is configured to store data and instructions that may be executed by the processor 206.

The memory 214 may include a graphical user interface (GUI) module 218 that, when executed, may cause the processor 206 to generate a graphical interface including data and including user-selectable elements accessible by a user to enter information and to make selections. In some embodiments, the graphical interface may be provided to a display device or touchscreen display (output device 201) via the output interface 211. The graphical interface may include instructions to guide an operator (an employee tasked with sorting waste products) through a process of scanning and sorting individual waste items.

The memory 214 may further include an optical data processing module 220 that, when executed, may cause the processor 206 to control the cameras 208 to capture optical data associated with a waste product. The memory 214 may also include a UPC module 222 that, when executed, may cause the processor 206 to parse and analyze the optical data to determine UPC data, image data, or any combination thereof. Additionally, the UPC module 222 may cause the processor 206 to compare the extracted UPC data to UPC data stored in the identified product data 214 to identify the waste product. The memory 214 may further include a scale module 226 that, when executed may cause the processor 206 to control the one or more scales 210 to determine a weight of the waste product.

The memory 214 may also include site-specific classification rules 228 that, when executed, may cause the processor 206 to determine a bin into which the waste product should be stored and to communicate information identifying the bin for presentation within the graphical interface on the display device (output device 201). The memory 230 may also include a printer module 230 that, when executed, may cause the processor 206 to control the label printer 216 to generate a label for the bin, a shipping manifest, other information, or any combination thereof. The memory 230 may store sorted waste product data 234, manifest data, packaging data, and other data, which may provide an audit trail for waste product handling and disposal.

In some embodiments, the memory 214 may include an unknown product module 232 that, when executed, may cause the processor 206 to send a message including data corresponding to the waste product to the waste identification system 102 through the network 106. The message may include an identifier associated with the item sorter device 110, the image data and optionally, the UPC data as well as an identifier associated with the item sorter device 110. In response to sending the image data, the item sorter device 110 may receive product data corresponding to the waste item and including at least one of a waste product classification and a bin assignment, which product data may update the identified product data 224. Further, in response to receiving the product data, the unknown product module 232 may cause the processor 206 to update the graphical interface presented to the display device (output device 201) to advise the operator that the previously unidentified waste product has now been identified and optionally to guide or otherwise prompt the operator to rescan the waste product so that the waste product can be sorted into the correct bin for storage.

In some embodiments, the memory 214 may also include sorted waste product data 234, which may include data related to a plurality of waste items, including the UPC data and the weight of each waste item and bin identification information for each waste item. Accordingly, each waste item and its storage location (within each bin) are stored in the sorted waste product data 234. In some embodiments, the memory 214 may further include a package module 236 that, when executed, may cause the processor 206 to monitor the number of waste items in each bin and the weight of each of the waste items as well as the total weight of the waste items in each bin. When the number of waste items reaches a threshold number or when the total weight of the waste items falls within a range of weights for the particular classification of weight or both, the package module 236 may cause the processor 206 to provide information for insertion into the graphical interface via the GUI module 218 to guide the operator to repackage the plurality of waste items from a "full" bin into a shipping container. Further, the package module 236 may cause the processor 206 to print a shipping label and optionally a shipping manifest via the label printer 216. Other embodiments are also possible.

In a particular example, the processor 206 of the item sorter device 110 may provide a graphical interface to the output device 201 (display) including instructions or information accessible by an operator to sort waste items into bins. The operator may lift and place a waste item onto the scale 210 and either actively scan the product via a barcode reader or other input device 212 or via the one or more cameras 208. The processor 206 may execute one or more of the instructions in the memory 214 to capture optical data associated with the waste item and to search the identified product data 224 based on the bar code, a UPC, or other optical data. If the product is identified, the processor 206 may apply the site-specific classification rules 228 to sort the identified waste item into a bin and to update the sorted waste product data 234 accordingly.

If the product is not identified, the processor 206 may communicate the optical data to the waste identification system 102, which may identify the waste product based on the optical data and classify the waste product based on retrieved information. The waste identification system 102 may communicate the identification information and classification information to the item sorter device 110. The item sorter device 110 may store the identification information and classification information in the identified product data 224. Further, the item sorter device 110 may provide an alert or other information to the display (output device 201) instructing the operator to rescan and weigh the waste item. After rescanning, the item sorter device 110 may provide information within the graphical interface instructing the operator where to place the waste item (i.e., into which bin the waste item should be placed).

It should be appreciated that, in some embodiments, the item sorter device 110 can be operated by a user to retrieve waste product data (such as SDS documents) for an unidentified waste product, to enter waste product data into the identified product data 224, and to select a bin for the waste product. In this example, the user's recorded data may be sent to the waste identification system 102 for verification, to update a database at the waste identification system 102, or any combination thereof.

Over a period of time, multiple item sorter devices 110 may independently prompt the waste identification system 102 to initiate data retrieval and waste product classification operations. Periodically, daily, or as unidentified waste products are identified and classified, the waste identification system 102 may share the updated or newly acquired data with one or more item sorter devices 110 so that the updated retrieval and classification data can benefit other sorter devices 110 with respect to subsequent waste item scans. Other embodiments are also possible.

Within a particular environment, multiple bins may be provided for receiving waste items. Each bin may be classified for receiving waste items of particular composition (in some instances) or waste items of neutral or stable composition such that the items can be safely stored together.

It should be appreciated that the sorting or classification of certain items into a particular bin may be location specific, such that some locations may have more bins and greater granularity with respect to the compositions of the items being stored than other locations. While safety rules for storage and transport may be consistent across all locations, the granularity for storing certain items in separate bins may vary. Other embodiments are also possible.

In some embodiments, when an "Unknown Item" is scanned by the item sorter device 110, the UPC data (and optionally optical data) associated with the unknown item may be sent to the waste identification system 102 to classify the item into reuse and disposal shipping bins. When the classification is returned by the waste identification system 102 to the item sorter device 110, a round-trip has occurred.

In one possible embodiment, the round-trip may include a classification process involving a human classifier, i.e., a human-in-the-loop. In this instance, after receiving the information from the item sorter device 110, the waste identification system 102 may synthesize all of the information gathered about the waste product and any additional information found on websites and provide the combined information to the human classifier to make the final shipping bin assignment. The human classifier may be an individual who works for the same company as the operator of the item sorter device 110 and who receives the combined information within a graphical interface on his or her computing device 108. In another embodiment, the human classifier may be an employee associated with a third party. Other embodiments are also possible.

In some embodiments, it may be possible to perform an automatic classification of the waste product and an automatic bin assignment, easing the burden of human classifiers. In some embodiments, the automatic classification may be verified by a human classifier. In other embodiments, the automatic classification can be provided to the operator of the item sorter device 110 without involvement of a human classifier.

In some embodiments, to be efficient and useful, the item sorter device 110 may need to recommend reuse and disposal shipping bins for the bulk of the products that it encounters. This requires a large effort to gather product data in advance, and provide identified product data 224 to the item sorter device 110 before waste items are scanned. Such identified product data may include classifications that are made through an automated tagging and rules process.

It should be appreciated that tags may represent facets, characteristics, or parameters of a product that can be used to assign the waste product to a storage/shipping bin. In an example, the tags may represent individual characteristics, such as "Solid," "Liquid," "Aerosol," "Toxic," "Non-Toxic," "Flammable," "Non-flammable," "Non-regulated," and so on. Other tags are also possible. In one example, waste product data may be associated with tags based on a set of about 6,000 specialized queries, which can be provided to a search engine, and the tags can be added to the product records, which are stored in the identified product data 224.

Each location (e.g., each waste pickup site) may have a set of rules that can be used to assign a waste product to one of a plurality of bins, which may include reuse bins, donation bins, disposal bins, and so on. These rules (e.g., site-specific classification rules) can be based on the simple tags assigned to each product. For instance, a first company may have a "Flammable Liquids" bin, which can be used to store and optionally ship waste products that are tagged as both flammable and liquid. Upon scanning and identification, the item sorter device 110 can use a query to determine the tags and can use the determined tags to assign each waste products to the proper bin for that company. Another company may call the same class of bin a "Flam Liq" bin or a "Flam Liq II" bin. However, the site-specific classification rules 228 may include the bin definitions for a particular site or company, which classification rules can be used to assign products for the appropriate bin for each site and each company.

Occasionally, a waste item cannot be identified by the item sorter device 110, causing the unknown product module 232 to cause the processor 206 of the item sorter device 110 to communicate UPC data, optical data, other data, or any combination thereof to the waste identification system 102.

Figure 3:
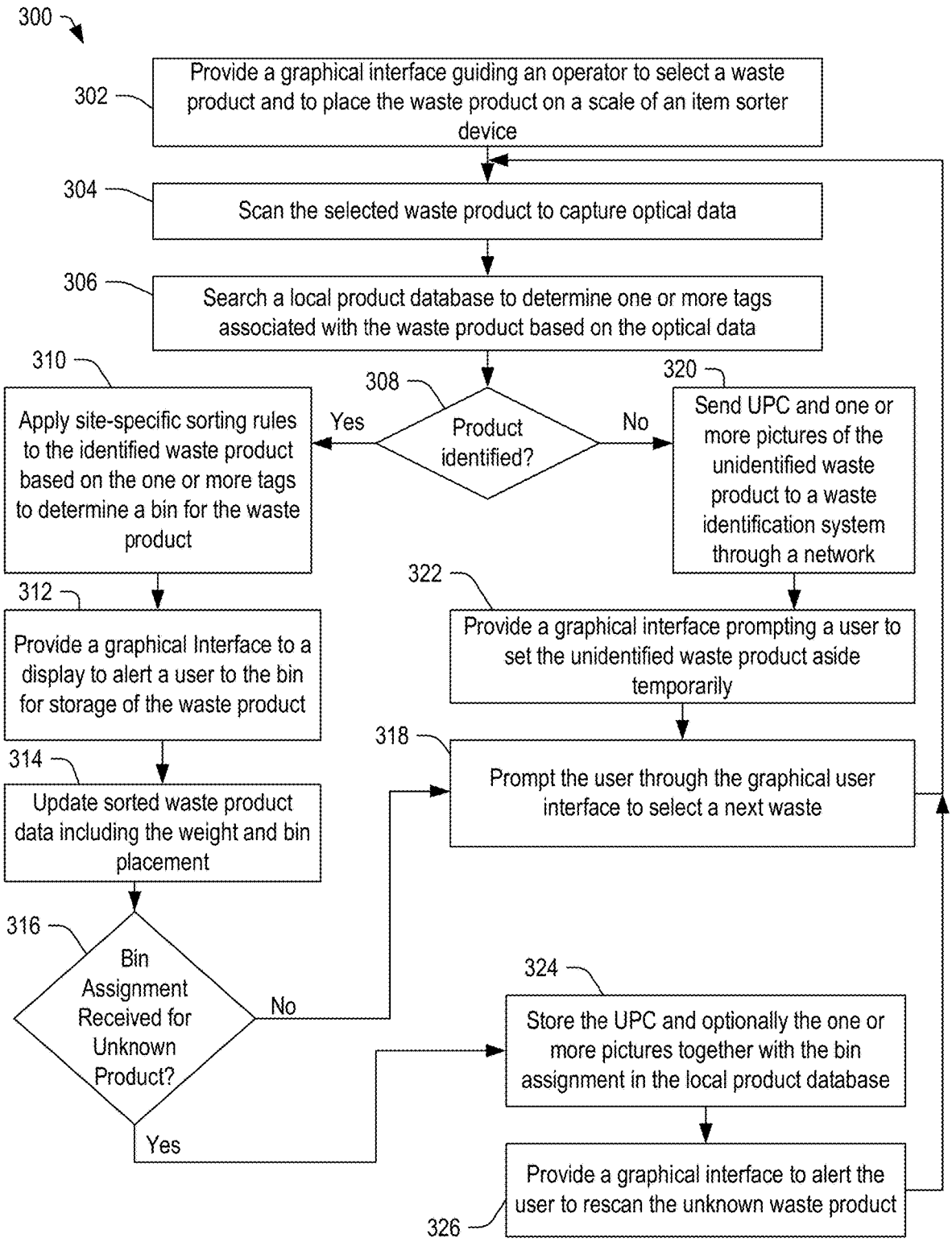
FIG. 3 depicts a diagram of a method of classifying a waste product and assigning the waste product to a bin, in accordance with certain embodiments of the present disclosure.

FIG. 3 depicts a diagram of a method 300 of classifying a waste product and assigning the waste product to a bin, in accordance with certain embodiments of the present disclosure. At 302, the method 300 can include providing a graphical interface guiding an operator to select a waste product and to place the waste product on a scale of an item sorter device. In some embodiments, the graphical interface may be provided to a display device.

At 304, the method 300 can include scanning the selected waste product to capture optical data. The waste product may be scanned using barcode readers, cameras, other optical sensors, or any combination thereof.

At 306, the method 300 may include searching a local product database to determine one or more tags associated with the waste product based on the optical data. The searching may be performed automatically in response to capturing the optical data. The one or more tags may indicate characteristics of each chemical of a waste product; physical, health, and environmental health hazards of the waste product; safety precautions for handling, storing, and transporting the waste item; guidance for handling the specific waste item; spill clean-up procedures; other information; or any combination thereof.

At 308, if the product is identified, the method 300 may include applying site-specific sorting rules to the identified waste product based on the one or more tags to determine a bin for the waste product, at 310. At 312, the method 300 can include providing a graphical interface to a display to alert a user to the bin for storage of the waste product.

At 314, the method 300 can include updating sorted waste product data including weight and bin placement. The method 300 can further include determining whether a bin assignment has been received for an unknown product, at 316. It should be appreciated that, as previously discussed, if an item was not identified, the item sorter device 110 may communicate data to the waste identification system 102 to identify and classify the item and instruct the user to set aside the item. After assigning the waste item to a bin at 312 and updating the sorted waste product data at 314, the device may determine if a bin assignment has been received for an unknown product at 316.

If a bin assignment has not been received, the method 300 may include prompting the user through the graphical user interface to scan a next waste product to capture optical data, at 318. The method 300 may then include scanning the selected waste product to capture optical data, at 304.

Otherwise, at 308, if the waste product is not identified, the method 300 can include sending UPC data and one or more pictures of the unidentified waste product to a waste identification system through a network, at 320. It should be appreciated that the UPC data and the one or more pictures may be sent from the item sorter device 110 to the waste identification system 102 through the network 106 of FIG. 1.

At 322, the method 300 can include providing a graphical interface prompting a user to set the unidentified waste product aside temporarily. Further, the method 300 can include prompting the user through the graphical user interface to scan a next waste product to capture optical data, at 318.

Returning to 316, if a bin assignment is received, the method 300 may include storing the UPC data and optionally one or more pictures together with the bin assignment in the local product database, at 324. At 326, the method 300 may include providing a graphical interface to alert the user to rescan the unknown waste product.

In some embodiments, each bin may be weighed independently to confirm the changes in weight due to storage of a waste item or product in the bin. Further, it should be appreciated that, once a particular bin is full or has reached a target weight, the method (or the item sorter device 110) may automatically prompt an operator to pack the items from the storage bin into a shipping container, seal the shipping container, and attach a shipping label and a shipping manifest. Other embodiments are also possible.

Figure 4:
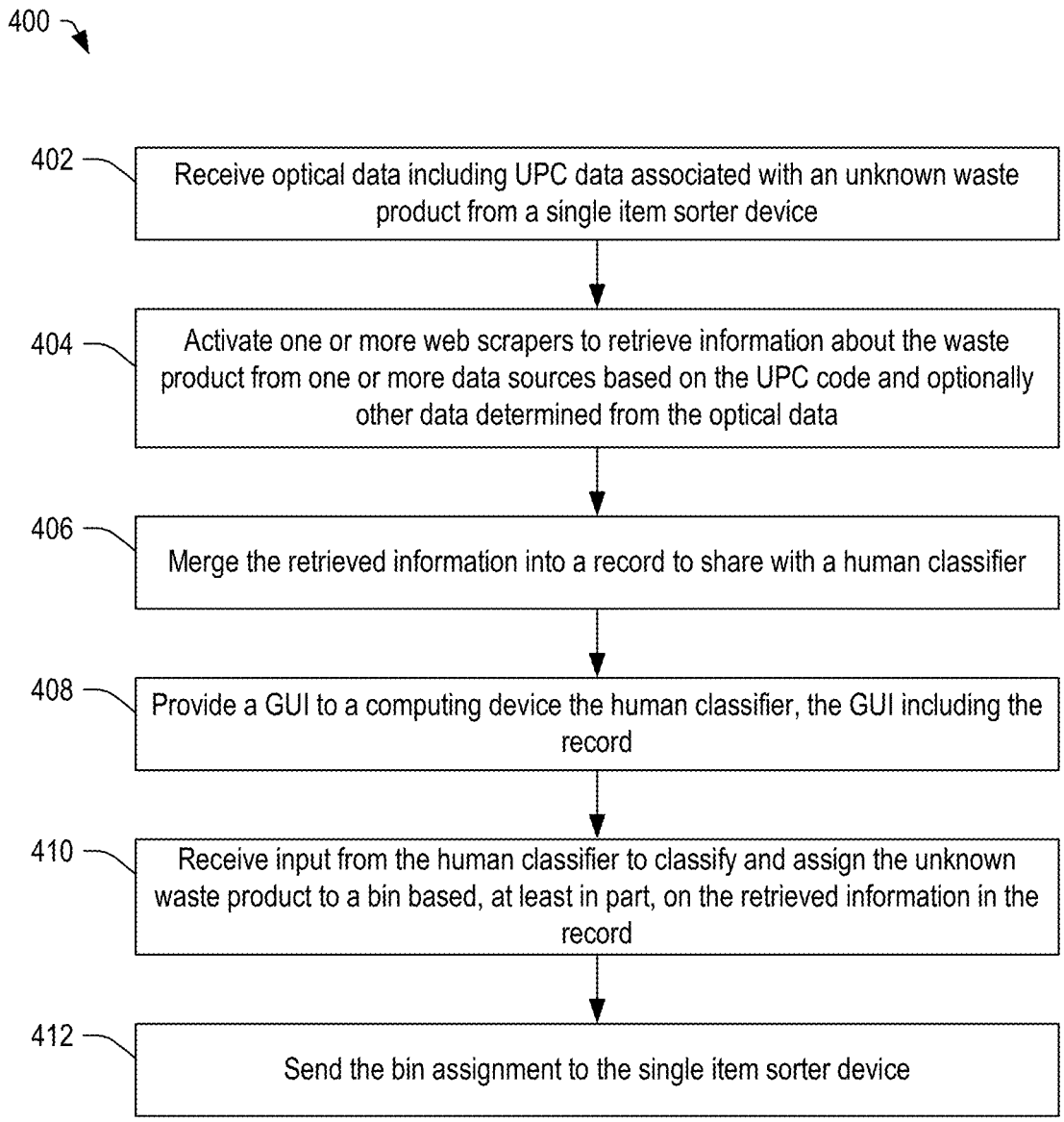
FIG. 4 depicts a diagram of a method of classifying a waste product using both automated and human classifiers, in accordance with certain embodiments of the present disclosure.

FIG. 4 depicts a diagram of a method 400 of classifying a waste product using both automated and human classifiers, in accordance with certain embodiments of the present disclosure. It should be appreciated that the method 400 is taken from the perspective of the waste identification system 102 in FIG. 1. When a scanned waste item is not included in the identified product data 224, the scanned waste item is an "unidentified" or "unknown" waste item, and the single item sorter 110 may send UPC data and other data associated with the unidentified or unknown waste item to the waste identification system 102.

At 402, the method 400 may include receiving optical data including UPC data associated with an unknown waste product from a single item sorter device. In an example, the item sorter device 110 may send the UPC data and one or more pictures of the waste item to the waste identification system 102. At 404, the method 400 may include activating one or more web scrapers to retrieve information about the waste product from one or more data sources based on the UPC code and optionally other data determined from the optical data.

At 406, the method 400 may include merging the retrieved information into a record to share with a human classifier. The record may include data extracted from one or more SDS documents, other data, and optionally links providing access to the one or more SDS documents. At 408, the method 400 can include providing a GUI including the record to a computing device of the human classifier. The human classifier may utilize data from the record plus any additional information about the waste product that the human classifier can find by searching one or more data sources, such as databases, manufacturer websites, and so on.

At 410, the method 400 can include receiving input from the human classifier to classify and assign the unknown waste product to a bin based, at least in part, on the retrieved information in the record. In some embodiments, the human classifier may be privy to additional information or may retrieve additional information on which the classification and assignment of the waste product to a bin may be determined. Other embodiments are also possible.

At 412, the method 400 can include sending the bin assignment to the single item sorter device. As discussed above, the bin assignment (and optionally classification data and UPC data) may be sent from the waste identification system 102 to the item sorter device 110 through the network 106, and the item sorter device 110 may store the bin assignment and other data in a local data storage. Other embodiments are also possible.

Figure 5:
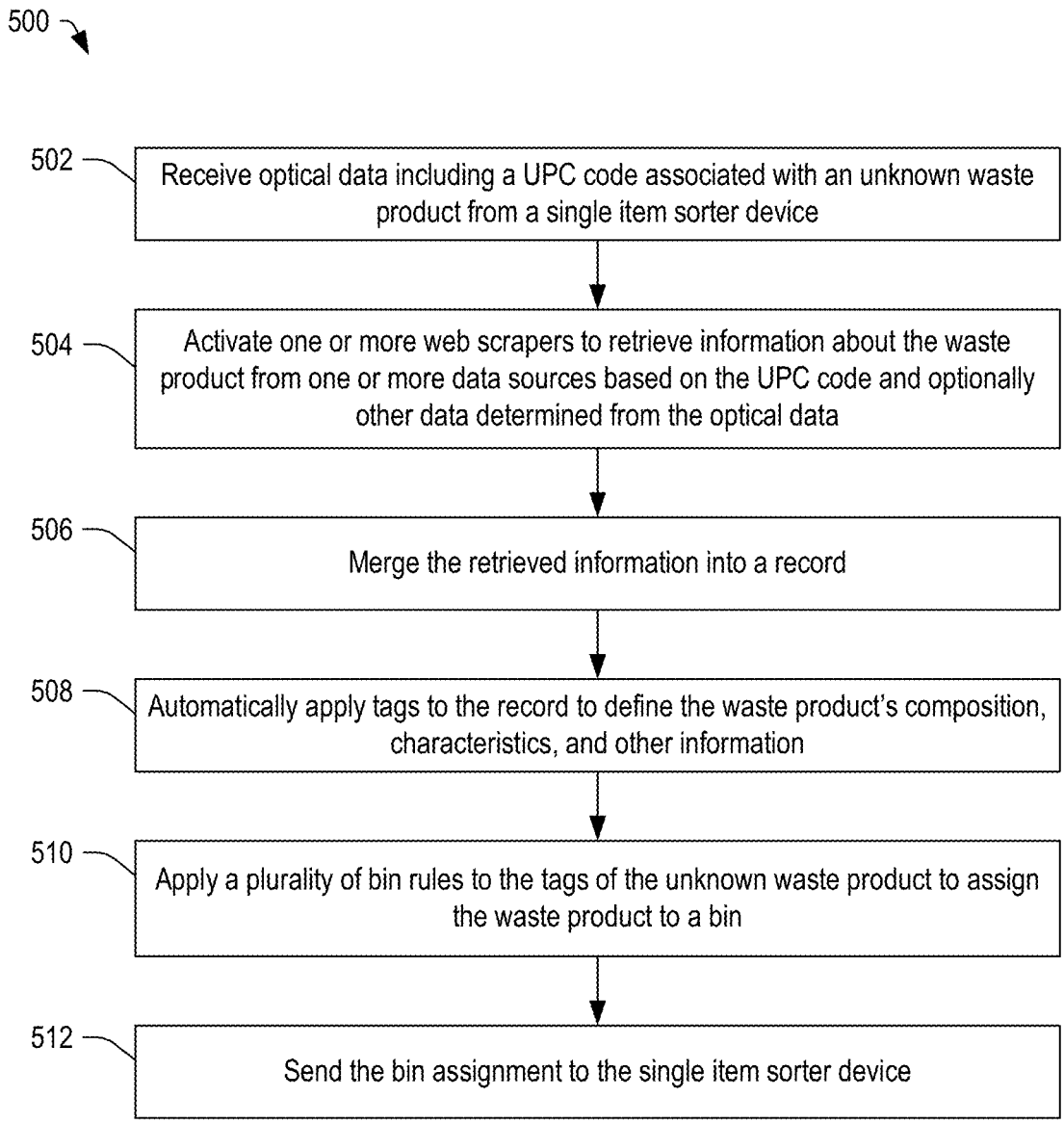
FIG. 5 depicts a diagram of a method of automatically classifying a waste product, in accordance with certain embodiments of the present disclosure.

FIG. 5 depicts a diagram of a method 500 of automatically classifying a waste product, in accordance with certain embodiments of the present disclosure. At 502, the method 500 may include receiving optical data including a UPC code associated with an unknown waste product from a single item sorter device. At 504, the method 500 may include activating one or more web scrapers to retrieve information about the waste product from one or more data sources based on the UPC code and optionally other data determined from the optical data.

At 506, the method 500 can include merging the retrieved information into a record. In some embodiments, the retrieved data may include the UPC code, data scraped or otherwise extracted from one or more SDS documents, document version information, links to view the SDS documents, other information, or any combination thereof. Unlike the human classification method described in the method 400 of FIG. 4, the method 500 may automatically classify the waste product using data scraped from various sources, processed into data tables, and stored in a product database. At 508, the method 500 may include automatically applying tags to the record to define the waste product's composition, characteristics, and other information.

At 510, the method 500 can include applying a plurality of bin rules to the tags of the unknown waste product to assign the waste product to a bin. The bin rules may include location-specific classification rules, chemical rules, other rules, or any combination thereof.

At 512, the method 500 may include sending the bin assignment to the single item sorter device. In some embodiments, the bin assignment may also include UPC data, composition data, classification data, other data, or any combination thereof. Other embodiments are also possible.

In one embodiment, the automatic classification method of FIG. 5 may be performed when the waste product can be identified to a level of reliability that is greater than a threshold and when specific data are available to trigger tags and rules. The waste identification system 102 may utilize the human classifier when the data reliability is below a threshold reliability, and the human classifier can apply human reasoning and fuzzy logic to disambiguate the product classification.

In some embodiments, the automatic classification of the method 500 of FIG. 5 and the human classification of the method 400 of FIG. 4 may be performed in parallel. If the waste identification system 102 successfully classifies the waste product, the automatic classification can be presented to the human classifier so that he or she can review the automatically determined result and can interact with one or more user-selectable elements of the GUI presenting the results to edit the results and optionally to override the automatic classification. Other embodiments are also possible.

In some embodiments, the automatic classification method 500 of FIG. 5 may become very good at identifying and classifying certain waste products and can perform such classifications very quickly. For example, non-regulated waste products, specific battery items, other items, or any combination thereof may be readily classified quickly. Challenging waste items may cause the waste identification system 102 to retrieve SDS documents, extract and organize data from the SDS documents, and present the information to a human classifier to review complex facets of the SDS to determine the correct bin.

Figure 6:
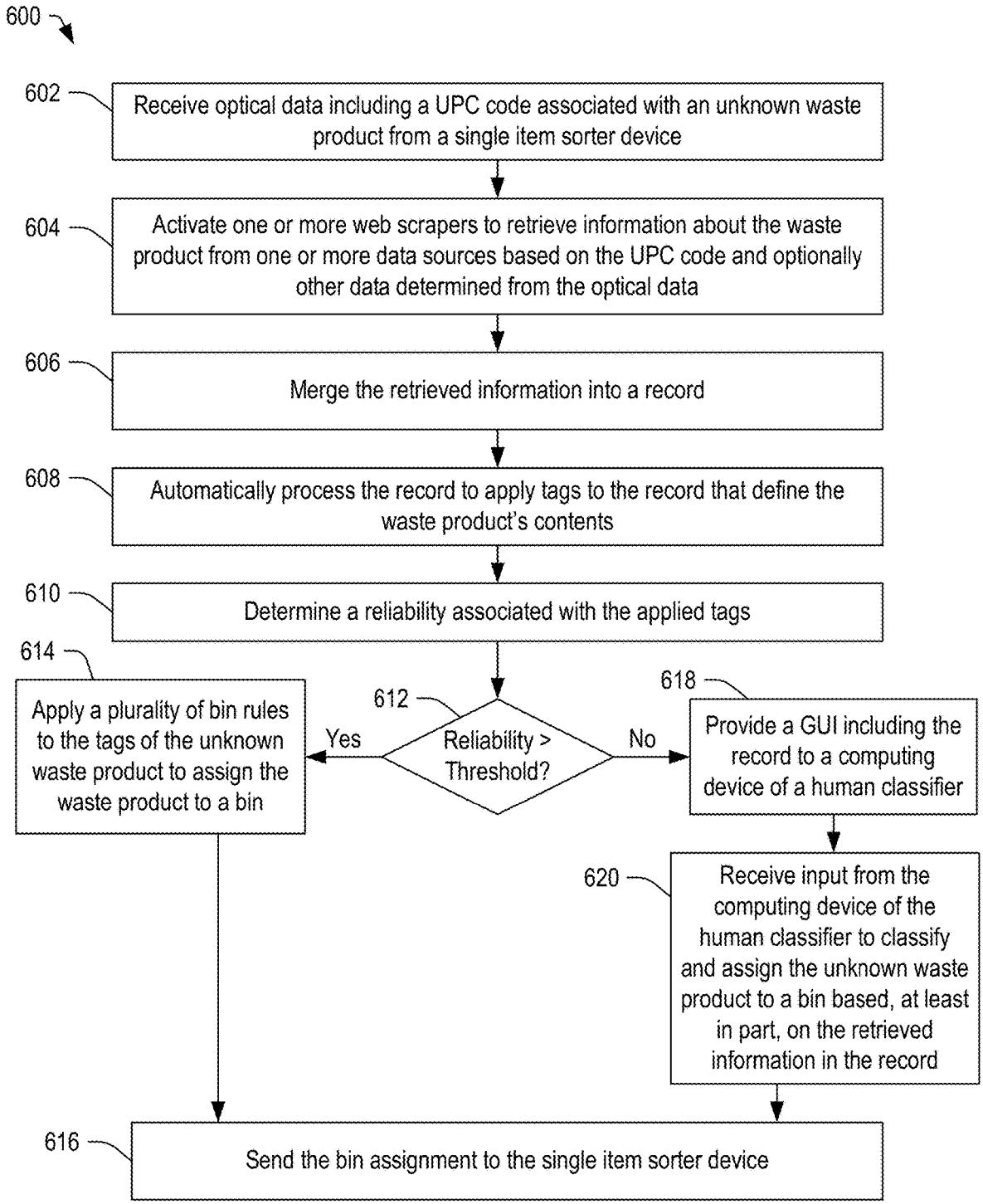
FIG. 6 depicts a diagram of a method of classifying a waste product, in accordance with certain embodiments of the present disclosure.

FIG. 6 depicts a diagram of a method 600 of classifying a waste product, in accordance with certain embodiments of the present disclosure. At 602, the method 600 may include receiving optical data including a UPC code associated with an unknown waste product from a single item sorter device. At 604, the method 600 can include activating one or more web scrapers to retrieve information about the waste product from one or more data sources based on the UPC code and optionally other data determined from the optical data.

At 606, the method 600 may include merging the retrieved information into a record. At 608, the method 600 may include automatically processing the record to apply tags to the record that define the waste product's contents. At 610, the method 600 may include determining a reliability associated with the applied tags.

At 612, if the reliability is greater than a threshold, the method 600 may include applying a plurality of bin rules to the tags of the unknown waste product to assign the waste product to a bin, at 614. At 616, the method 600 can include sending the bin assignment to the single item sorter device. As discussed above, the bin assignment may include UPC data, image data, classification data, SDS data, a bin name (identifier), other data, or any combination thereof. In some embodiments, the bin assignment data may be stored in the sorted waste product data 234 in FIG. 2.

Returning to 612, if the reliability is less than or equal to the threshold, the method 600 can include providing a GUI including the record to a computing device of a human classifier, at 618. The GUI may include data from the record, a reliability indicator corresponding to the determined reliability, and one or more user-selectable elements accessible by the user to review the data, edit data, and optionally select a bin, assigning the waste product to a bin (or otherwise classifying the waste product). Other embodiments are also possible.

At 620, the method 600 can include receiving input from the computing device of the human classifier to classify and assign the unknown waste product to a bin based, at least in part, on the retrieved information in the record. At 616, the method 600 may further include sending the bin assignment to the single item sorter device. Other embodiments are also possible.

Figure 7:
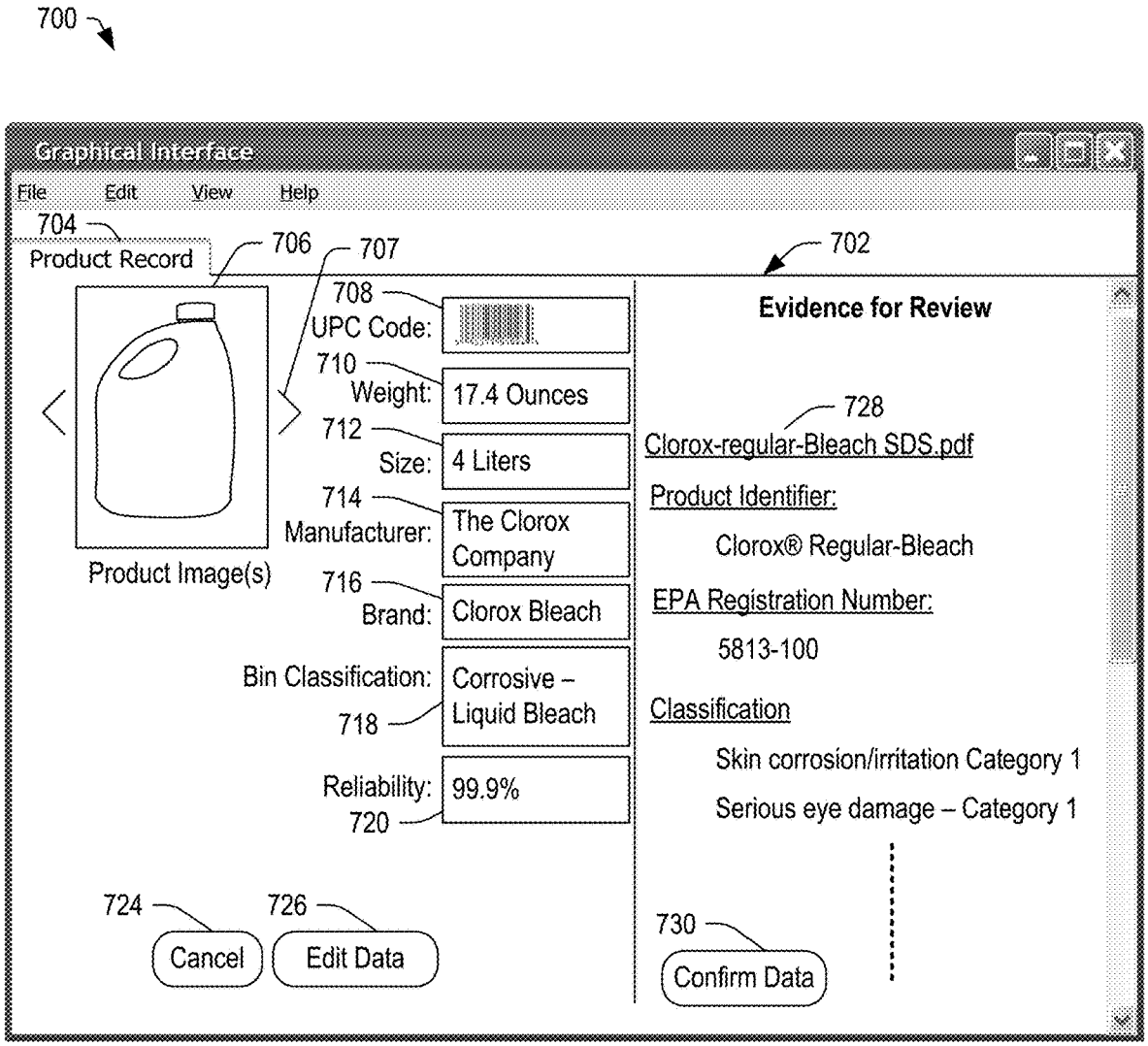
FIG. 7 depicts a graphical interface for presentation to a human classifier, in accordance with certain embodiments of the present disclosure.

FIG. 7 depicts a graphical interface 700 for presentation to a human classifier, in accordance with certain embodiments of the present disclosure. The graphical interface 700 may include data 702 and may include user-selectable elements, such as a "Product Record" tab 704, a "Cancel" button 724, an "Edit" button 726, clickable links 728, and a "Confirm Data" button 730. Further, the data 702 may include image data 706, UPC code or barcode data 708, weight data 710, size data 712 (which may be determined automatically from the product packaging), manufacturer data 714, brand data 716, bin classification data 718, and reliability data 720. Further, the graphical interface 700 may include a user-selectable arrow 707 that can be accessed by an operator to transition between image data 706 of the waste product (if other images are available). A corresponding arrow may be presented on the other side of the image data 706 to toggle between images.

In this particular example, the optical data may be processed to extract the UPC data 708. The item sorter device 110 may retrieve the waste product information from the identified product data 224 and may populate the size data 712, the manufacturer data 714, and the brand data 716. Further, the weight data 710 may be determined by the scale 210. In this example, the bin classification 718 may be determined automatically based on the tags stored in the identified product data 224 and by applying the site-specific classification rules 228. In another example, the bin classification 718 may be stored with the identified product data 224. Other embodiments are also possible.

Further, the reliability data 720 may be determined based on data stored in the identified product data 224. In other embodiments, the reliability data 720 may be calculated automatically for each waste product based on a comparison of the optical data to the data stored in the identified product data 224. Other embodiments are also possible.

It should be appreciated that the human classifier may interact with the "Edit Data" button 726 to access one or more of the fields to update the data, to remove one or more of the links 728 corresponding to "Evidence for Review," and optionally to adjust data in the fields. Other embodiments are also possible. Further, the human classifier may select the "Confirm Data" button 730 to confirm the classification and the other data provided within the graphical interface 700.

Figure 8:
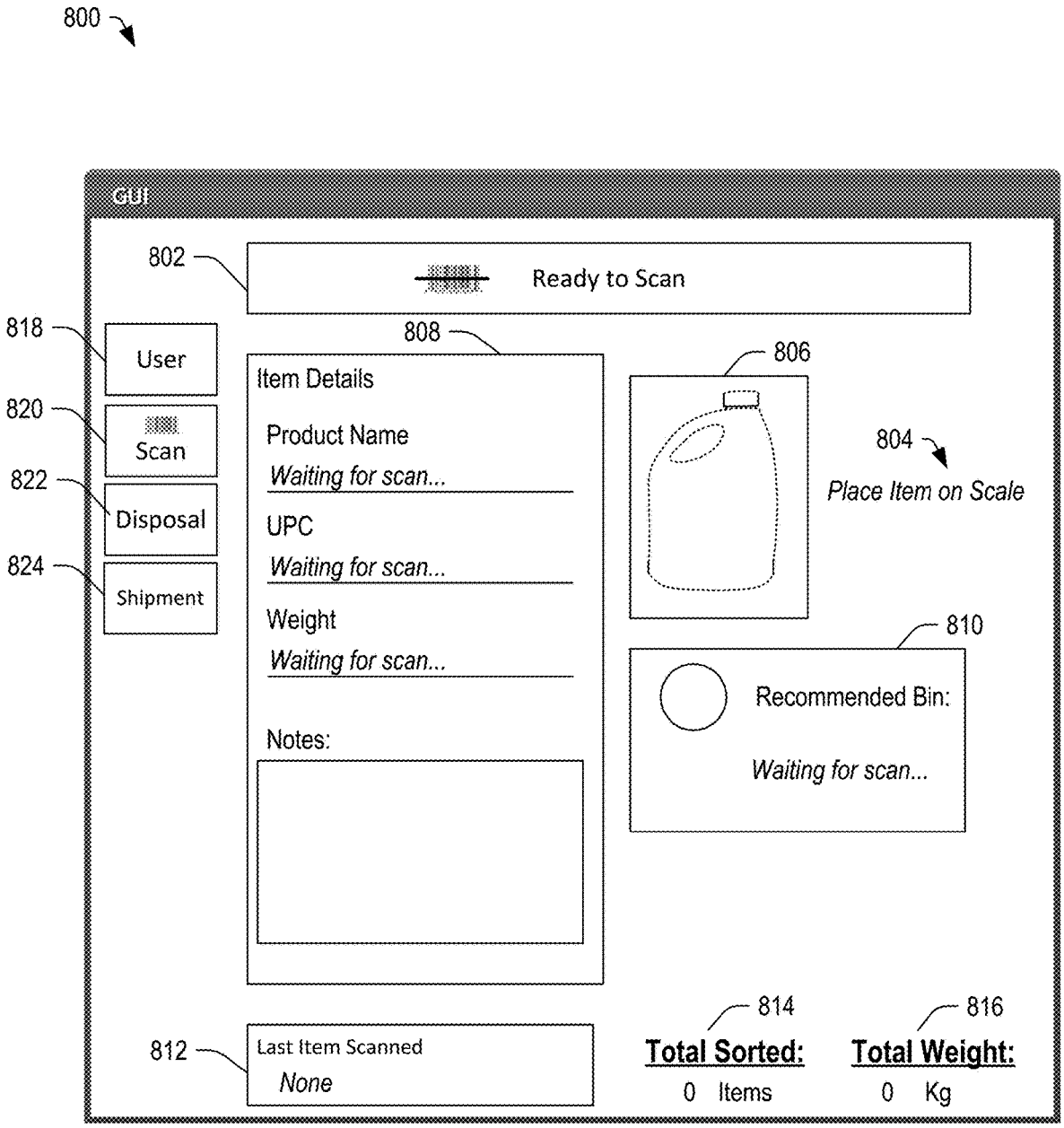
FIG. 8 depicts a graphical interface for presentation on a display device of an item sorter device, in accordance with certain embodiments of the present disclosure.

FIG. 8 depicts a graphical interface 800 for presentation on a display device of an item sorter device 110, in accordance with certain embodiments of the present disclosure. The graphical interface 800 may present text, images, and user-selectable options, including selectable tabs, buttons, clickable links, text fields, radio buttons, checkboxes, pull-down menus, other user-selectable elements, or any combination thereof. In some embodiments, the In this example, the graphical interface 800 may include a status indicator 802 indicating that the item sorter device 110 is "Ready to Scan" a waste item. The graphical interface 800 can also include guidance or instructions, generally indicated at 804, instructing the operator to "Place Item on Scale". The graphical interface 800 can also include a box or block 806 configured to display a scanned image of a waste product. Further, the graphical interface 800 can display item details 808, a recommended bin 810, a last item scanned 812, a total number of items sorted 814, and a total weight of the items sorted 816. The item details 808 can include a product name, UPC data, a weight of the product, and other information (which may be provided by a waste identification system 102, a human classifier, retrieved from identified product data 224, or entered by the operator via an input device, such as a keyboard or touchscreen. Other embodiments are also possible.

The graphical interface 800 may also include user-selectable buttons or options, including a "User" button 818 accessible by the user to login, logout, or switch between users. The graphical interface 800 can also include a "Scan" button 820 that can be accessed by a user to enter a scan mode. In the illustrated example, the Scan button 820 has been selected, and the item sorter device 110 is in a scan mode awaiting a scan of a waste item.

The graphical interface 800 can include a "Disposal" button 822 that can be accessed by a user to view waste product disposal information, such as a list of bins and the waste items stored in each bin. Further, the graphical interface 800 may include a "Shipment" button 824 that can be accessed by the user to package waste items from the bins for shipment, including printing a manifest and a shipping label and displaying instructions for the user. Other embodiments are also possible.

In conjunction with the systems, methods and device described herein, an item sorter device may include an optical device configured to capture optical data associated with a waste product. The item sorter device may be configured to determine UPC data from the optical data and to classify the waste product into a selected one of a plurality of bins when the UPC data matches identified product data in a memory of the item sorter device. When the UPC data does not match the identified product data, the item sorter device may send data including the UPC data, the optical data, other data, or any combination thereof to a waste identification system through a communications network. In response to sending the data, the item sorter device may receive classification data and may prompt a user to rescan the waste item so that the item sorter device can classify the waste item according to the received classification data.

As discussed above, the item sorter device may include a display, and may be configured to provide a graphical interface to the display. The graphical interface may include instructions to prompt a user to perform various tasks, such as scanning an item, placing an item on a scale to weigh it, and sorting the item into a bin. Further, the graphical interface may instruct the user that a particular bin is full (based on weight or quantity) and may prompt the user to access a shipment option to package the waste items for shipment, to print a shipping label, and to print a manifest. Other embodiments are also possible.

When a waste item is not identified locally, the item sorter device may provide a graphical interface to the display instructing the user to set the waste item aside. Subsequently, when classification data for the previously unidentified waste item is received from the waste identification system, the item sorter device may provide an update to the graphical interface (such as popup, a message, a prompt, or another alert) to instruct the user that the classification data has been received and to rescan the item. Other embodiments are also possible.

Further, with respect to the waste identification system, the waste identification system may be implemented as a server device, as a cloud-computing system, as another type of data processing system, or any combination thereof. In some embodiments, the waste identification system may extract the UPC data from the optical data. The waste identification system may receive optical data and optionally UPC data associated with an unidentified waste item. The system may activate one or more web crawlers, spiders, bots, or other automated retrieval components to retrieve data corresponding to the UPC data, the optical data, or both. The waste identification system may combine the retrieved data into a combined record, which may be processed automatically, reviewed by a human classifier, or both to apply tags to the data associated with the waste item and to classify the waste item according to the tags. The waste identification system may then send the record and the tagged data items to the item sorter device through the network.

Upon receiving the record and the tagged data items, the item sorter device may be configured to update the identified product data so that subsequent scans of the same waste item can be readily identified. Further, the item sorter device may be configured to prompt the user to rescan the unidentified waste item so that it can be classified. Other embodiments are also possible.

Although the present invention has been described with reference to preferred embodiments, workers skilled in the art will recognize that changes may be made in form and detail without departing from the scope of the invention.

What is claimed is:

1. A system comprising:

an item sorter device including:

a first network interface configured to couple to a network to communicate with one or more remote devices;

at least one optical device configured to capture optical data associated with a waste product;

a display; and a processor coupled to the at least one optical device, to the first network interface, and to the display, the processor configured to automatically:

extract universal product code (UPC) data from the optical data;

search one or more data sources based on the UPC data to determine a match;

determine a bin of a plurality of bins for storage of the waste product based on the match and based on site-specific classification rules;

provide a graphical interface to the display indicating the determined bin; and a waste identification system coupled to the network, the waste identification system comprising:

a second network interface coupled to the network; and a processor coupled to the second network interface, the processor configured to:

receive data from the processor of the item sorter device;

activate one or more web scrapers to retrieve data corresponding to the received data from a plurality of data sources through the network;

compile the retrieved data into a record;

selectively apply tags defining characteristics of the waste product to data within the record; and send the record to the item sorter device to classify the waste item into the bin.

2. The system of claim 1, wherein the item sorter device further comprises a scale coupled to the processor and configured to determine a weight of the waste product.

3. The system of claim 2, wherein the item sorter device further comprises a memory coupled to the processor and storing one or more data sources, the one or more data sources including identified product data including UPC data associated with waste products, tags defining characteristics of the waste products, and bin classifications corresponding to the waste products.

4. The system of claim 2 wherein the item sorter device further comprises a memory coupled to the processor and configured to store sorted waste product data including a plurality of scanned waste products and corresponding weights for each bin of a plurality of bins.

5. The system of claim 4, wherein the item sorter device further comprises a printer coupled to the printer and configured to print at least one of a manifest listing each waste item of a selected bin of the plurality of bins and a shipping label for the selected bin.

6. The system of claim 1, wherein, when the processor is unable to determine a match, the processor is configured to send at least one of the UPC data and the optical data to the waste identification system to the waste identification system and, in response to sending the at least one, the processor is configured to receive at least one of a data record corresponding to the waste item and a bin classification for storage of the waste item.

7. The system of claim 1, wherein the waste identification system is configured to update one or more item sorter devices through the network by sending one or more waste product records including the record to the one or more item sorter devices.

8. A system comprising:

a waste identification system including:

a network interface coupled to a network; and a processor coupled to the network interface, the processor configured to:

receive data from an item sorter device through the network, the data including at least one of universal product code (UPC) data and optical data associated with an unidentified waste product;

automatically activate one or more web scrapers to retrieve data corresponding to the received data from a plurality of data sources through the network;

automatically compile the retrieved data into a record;

selectively apply tags defining characteristics of the waste product to data within the record; and send the record to the item sorter device to classify the unidentified waste item into a bin of a plurality of bins.

9. The system of claim 8, wherein the processor is configured to selectively apply the tags by:

automatically processing data from the record to apply the tags defining characteristics of the waste product; and providing a graphical interface including data from the record and the automatically applied tags and including one or more user-selectable elements accessible by a human classifier to selectively edit or confirm the record.

10. The system of claim 8, further comprising:

an item sorter device including:

a network interface configured to communicate with waste identification system through the network;

an optical device configured to capture the optical data associated with the waste product;

a display; and a processor coupled to the network interface, the optical device, and the display, the processor configured to automatically:

extract universal product code (UPC) data from the optical data;

search a local database based on the UPC data to determine a match;

determine a bin of a plurality of bins for storage of the waste product based on the match and based on site-specific classification rules; and provide a graphical interface to the display indicating the determined bin.

11. The system of claim 10, wherein the item sorter device further comprises a scale coupled to the processor and configured to determine a weight of the waste product.

12. The system of claim 11, wherein the item sorter device further comprises a memory coupled to the processor and storing one or more data sources, the one or more data sources including identified product data including UPC data associated with waste products, tags defining characteristics of the waste products, and bin classifications corresponding to the waste products.

13. The system of claim 11 wherein the item sorter device further comprises a memory coupled to the processor and configured to store sorted waste product data including a plurality of scanned waste products and corresponding weights for each bin of a plurality of bins.

14. The system of claim 10, wherein the item sorter device further comprises a printer coupled to the printer and configured to print at least one of a manifest listing each waste item of a selected bin of the plurality of bins and a shipping label for the selected bin.

15. The system of claim 10, wherein, when the processor of the item sorter device is unable to determine a match, the processor is configured to:

send the data to the waste identification system;

receive the record from the waste identification system in response to sending the data; and selectively apply site-specific classification rules to the received record to classify the waste item into the bin.

16. A method comprising:

scanning a waste product to capture optical data;

comparing data corresponding to the optical data of the waste product to identified product data in a memory of an item sorter device to determine a match;

in response to determining the match:

automatically determining a bin of a plurality of bins into which the waste product is to be sorted; and providing a graphical interface to a display device of the item sorter device to identify the bin; and when the match is not determined:

automatically sending the data corresponding to the optical data to a waste identification system through a network;

receiving a record corresponding to the waste item from the waste identification system through the network, the record including tags defining characteristics of the waste product; and providing the graphical interface to the display device of the item sorter device to identify the bin based on the tags.

17. The method of claim 16, further including selectively printing at least one of a manifest and a shipping label associated with the bin.

* * * * *